US006840288B2

(12) United States Patent
Zhu et al.

(10) Patent No.: US 6,840,288 B2
(45) Date of Patent: Jan. 11, 2005

(54) FIRE-RETARDANT FABRIC WITH IMPROVED TEAR, CUT, AND ABRASION RESISTANCE

(75) Inventors: Reiyao Zhu, Midlothian, VA (US); Richard H. Young, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 257 days.

(21) Appl. No.: 10/163,935

(22) Filed: Jun. 6, 2002

(65) Prior Publication Data

US 2003/0226612 A1 Dec. 11, 2003

(51) Int. Cl.[7] ..... D03D 15/02

(52) U.S. Cl. ..... 139/425 R; 139/420 R; 139/426 R; 2/2.5; 428/911

(58) Field of Search ..... 2/2.5; 139/420 R, 139/425 R, 426 R; 428/911, 902; 442/200, 219

(56) References Cited

U.S. PATENT DOCUMENTS

| | | | | | |
|---|---|---|---|---|---|
| 2,619,705 | A | * | 12/1952 | Foster | 428/219 |
| 4,470,251 | A | | 9/1984 | Bettcher | |
| 4,602,385 | A | * | 7/1986 | Warren | 2/2.14 |
| 4,750,443 | A | * | 6/1988 | Blaustein et al. | 112/420 |
| 4,923,741 | A | * | 5/1990 | Kosmo et al. | 442/187 |
| 4,967,548 | A | | 11/1990 | Fangeat et al. | |
| 5,119,512 | A | | 6/1992 | Dunbar et al. | |
| 5,120,599 | A | * | 6/1992 | Lewis | 442/329 |
| 5,299,602 | A | | 4/1994 | Barbeau et al. | |
| 5,482,763 | A | | 1/1996 | Shaffer et al. | |
| 5,637,114 | A | * | 6/1997 | Hohnke | 8/137 |
| 5,926,842 | A | * | 7/1999 | Price et al. | 2/2.5 |
| 6,559,079 | B1 | * | 5/2003 | Bachner, Jr. | 442/246 |

FOREIGN PATENT DOCUMENTS

| | | |
|---|---|---|
| GB | 2324100 | 10/1998 |
| WO | WO 97/27769 | 8/1997 |
| WO | WO 0066823 A | 11/2000 |
| WO | WO 01/86046 | 11/2001 |

* cited by examiner

*Primary Examiner*—John J. Calvert
*Assistant Examiner*—Robert H. Muromoto Jr.

(57) ABSTRACT

A woven fabric useful in protective apparel made from yarn components comprising a body fabric yarn component, a synthetic ripstop yarn component having at least 20% greater tensile strength than the body fabric yarn component, and a cut resistant yarn component comprising a yarn having a synthetic staple-fiber sheath and inorganic core, the body fabric yarn component, the ripstop yarn component, and cut-resistant yarn components all being comprised of at least one yarn and each yarn component distinguished from the adjacent yarn component by interweaving orthogonal yarn components.

17 Claims, 3 Drawing Sheets

FIRE-RETARDANT FABRIC WITH IMPROVED TEAR, CUT, AND ABRASION RESISTANCE

BACKGROUND OF THE INVENTION

This invention relates to fabrics useful in protective garments, especially garments known as turnout gear which are useful for firefighters, but such fabrics and garments also have use in industrial applications where workers may be exposed to abrasive and mechanically harsh environments where fire and flame protection is needed. The garments, which include coats, coveralls, jackets, and/or pants can provide protection against fire, flame, and heat.

Most turnout gear commonly used by firefighters in the United States comprise three layers, each performing a distinct function. There is an outer shell fabric often made from flame resistant aramid fiber such as poly (meta-phenylene isophthalamide) (MPD-I) or poly (para-phenylene terephthalamide) (PPD-T) or blends of those fibers with flame resistant fibers such as polybenzimidazoles (PBI). Adjacent to the outer shell fabric is a moisture barrier and common moisture barriers include a laminate of Crosstech® PTFE membrane on a woven MPD-I/PPD-T substrate, or a laminate of neoprene on a woven polyester/cotton substrate. Adjacent the moisture barrier is an insulating thermal liner which generally comprises a batt of heat resistant fiber.

The outer shell serves as initial flame protection while the thermal liner and moisture barrier protect against heat stress.

Since the outer shell provides primary defense it is desirable that this shell be durable and able to withstand abrasion and not tear or be cut in harsh environments. This invention provides for such a fabric that is flame resistant and has improved tear, cut, and abrasion attributes.

There are a number of fabrics described in the prior art which utilize bare steel wires and cords, primarily as armored fabrics. For example, WO 9727769 (Bourgois et al.) discloses a protective textile fabric comprising a plurality of steel cords twisted together. WO 200186046 (Vanassche et al.) discloses a fabric comprising steel elements used to provide cut resistance or reinforcement for protective textiles. The steel elements are either a single steel wire, a bundle of non-twisted steel wires, or a cord of twisted steel fibers. GB 2324100 (Soar) discloses a protective material made from twisted multi-strand cable which may be stitched to one or more layers of Kevlar® to form a unitary material. The use of bare metal wire presents processing challenges and garment aesthetic (comfort and feel) problems and is undesirable.

U.S. Pat. No. 4,470,251 (Bettcher) discloses a cut resistant yarn made by winding a number of synthetic fibers yarns, such as nylon and aramid, around a core of strands of stainless steel wire and a high strength synthetic fiber such as aramid, and a safety garment made from the wound yarn.

U.S. Pat. No. 5,119,512 (Dunbar et al.) discloses a protective fabric made from cut resistant yarn comprising two dissimilar non-metallic fibers, at least one being flexible and inherently cut resistant and the other having a level of hardness at above three Mohs on the hardness scale.

SUMMARY OF THE INVENTION

The present invention is directed to a woven fabric useful in protective apparel made from yarn components comprising a body fabric yarn component, a synthetic ripstop yarn component having at least 20% greater tensile strength than the body fabric yarn component, and a cut resistant yarn component comprising a yarn having a synthetic staple-fiber sheath and inorganic core, the body fabric yarn component, the ripstop yarn component, and cut-resistant yarn components all being comprised of at least one yarn and each yarn component distinguished from the adjacent yarn component by interweaving orthogonal yarn components. Preferably, the ripstop yarn component can comprises a textured or bulked continuous filament yarn. The ripstop yarn is preferably made from a yarn made from fire-resistant fibers and the preferred fire-resistant fiber is made from poly (p-phenylene terephthalamide). The ripstop yarn component can also contain, in addition to a yarn made from fire-resistant fibers, nylon fibers in an amount of up to 20% by weight of the ripstop yarn component. Preferably, the staple-fiber sheath of the sheath/core yarn in the cut resistant yarn component comprises staple fibers made from poly(p-phenylene terephthalamide) and the inorganic core comprises metal fiber. The staple-fiber sheath of this cut resistant yarn component yarn can contain cut resistant staple fibers, and can also contain, in addition to the cut resistant staple fibers, nylon fibers in an amount of up to 20% by weight of the cut resistant yarn component yarn. The body fabric component comprises yarns of fire-resistant fibers and preferably contains, in addition to fire-resistant fibers, nylon fibers in an amount of up to 20% by weight of the body fabric yarn.

One embodiment of this invention is directed to a woven fabric useful in protective apparel made from orthogonal warp and fill yarn components comprising a body fabric yarn component, a synthetic ripstop yarn component having at least 20% greater tensile strength than the body fabric yarn component, and a cut resistant yarn component comprising a yarn having a synthetic fiber sheath and inorganic core, the body fabric yarn component, the ripstop yarn component, and cut-resistant yarn components all being comprised of individual or plied warp and fill yarns in the fabric, and wherein every fifth to ninth orthogonal warp and fill yarn component is a ripstop yarn component. Preferably, a cut resistant yarn component is positioned between every ripstop yarn component in both the warp and fill. The ripstop yarn component can contain a textured or bulked continuous filament yarn.

Another embodiment of this invention is directed to a woven fabric useful in protective apparel made from orthogonal yarn components comprising a body fabric yarn component, a synthetic ripstop yarn component having at least 20% greater tensile strength than the body fabric yarn component, and a cut resistant yarn component comprising a yarn having a synthetic staple-fiber sheath and inorganic core, the body fabric yarn component, the ripstop yarn component, and cut-resistant yarn components all being comprised of at least one yarn and each yarn component distinguished from the adjacent yarn component by interweaving orthogonal yarn components, said ripstop yarn components being orthogonal to the cut resistant yarn components. The ripstop yarn component can contain a textured or bulked continuous filament yarn.

This invention is also directed to a process for making a woven fabric useful in protective apparel, made from warp and fill yarn components, comprising weaving a fabric from a body fabric yarn component and a cut-resistant yarn component, the cut resistant yarn component comprising a yarn having a synthetic staple-fiber sheath and inorganic core, and inserting into the weave at every fifth to ninth warp and fill component a synthetic ripstop yarn component having at least 20% greater tensile strength than the body fabric yarn component.

In another embodiment, this invention is directed to a process for making a woven fabric useful in protective apparel made from orthogonal yarn components comprising weaving a fabric from a body fabric yarn component, inserting into the weave at every fifth to ninth yarn component a ripstop yarn component to create a parallel array of synthetic ripstop yarn components, each component having at least 20% greater tensile strength than the body fabric yarn component, and inserting into the weave, orthogonal to the array of parallel ripstop yarn components, a parallel array of cut-resistant yarn components, each cut resistant yarn components comprising a yarn having a synthetic staple-fiber sheath and inorganic core.

DETAILED DESCRIPTION OF THE INVENTION

Figure 1:
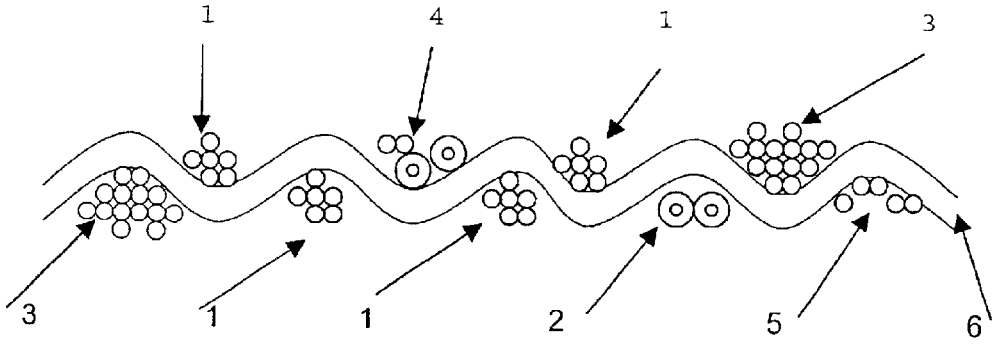
FIG. 1 is an illustration of some of the possible yarn components in the fill direction separated by interweaving orthogonal warp yarn components in the fabric of this invention.

The fabrics of this invention have in combination improved cut resistance and improved tear resistance over prior art fabrics and preferably have improved abrasion resistance. The fabrics are woven using known machines for weaving fabric, and can be incorporated into protective apparel and garments of various types. These fabrics typically weigh in the range of 4 to 12 ounces per square yard and can be any orthogonal weave, however, plain weave and 2×1 twill weave are the preferred weaves.

This invention comprises three types of yarn components, a body fabric yarn component, a ripstop yarn component, and a cut resistant yarn component. As referred to herein, a yarn component can be a yarn, a plied yarn, or a combination of yarns or a combination of plied yarns. In general, each yarn component lying in one direction of a woven fabric is distinguished from the adjacent yarn component in that same direction by interweaving orthogonal yarn components. In a plain weave, for example, the warp and fill yarn components are interwoven wherein the warp yarn components go over and under the fill yarn components, delineating each fill yarn component and distinguishing it from the adjacent fill yarn component. Likewise, adjacent warp yarn components alternate the direction of the interweave with the fill yarn; that is, a first warp yarn component will go over a fill yarn component and a second adjacent warp yarn component will go under that same fill yarn component. This alternate interweaving action is duplicated throughout the fabric creating the classic plain weave structure. Therefore, the fill yarn components also delineate each warp yarn component from adjacent warp yarn components. In a twill weave, the warp and fill yarn components are interpreted the same even though there is less actual interweaving of warp and fill yarn components. In a 2×1 twill weave, the offset staggered interweaving structure of that weave means a warp yarn component passes over more than one fill yarn component and lies directly adjacent to another warp yarn component periodically in the fabric. However, the warp and fill yarn components are still delineated by each other even if they are offset or staggered in the fabric, and the yarn components can be clearly identified by inspection.

Typically, the major portion of the fabric is made from body fabric yarn components and these components normally comprise yarns containing fire-resistant fibers. The term "fire resistance fibers" as used herein means staple or filament fibers of polymers containing both carbon and hydrogen and which may also contain other elements such as oxygen and nitrogen, and which have a LOI 25 and above.

Suitable fire-resistant fibers include poly (meta-phenylene iosphthalamide) (MPD-I), poly (para-phenylene terephthalamide) (PPD-T), polybenzimidazoles (PBI), polyphenylene benzobisoxazole (PBO), and/or blends or mixtures of those fibers. For improved abrasion resistance, the body fabric yarn components can have, in addition to the fire-resistant fibers, up to 20 percent by weight nylon fibers, preferably less than 10 percent by weight. The body fabric yarn components are preferably staple yarns containing 60 weight percent PPD-T fiber and 40 weight percent PBI fiber. The preferred form and size of the body fabric yarn component is a plied yarn of the above composition having a cotton count in the range of 16/2 to 21/2.

The ripstop yarn component of the fabric is useful in providing tear strength to the fabric and has a tensile strength which is at least 20% greater than the tensile strength of a body fabric yarn component. The ripstop yarn component typically contains at least one continuous multifilamentary yarn which is also fire-resistant. Suitable fire-resistant fibers include those made from aramids such as poly (para-phenylene terephthalamide) (PPD-T), poly(meta-phenylene isophthalamide)(MPD-I) and other high strength polymers such as poly-phenylene benzobisoxazole (PBO) and/or blends or mixtures of those fibers. The ripstop yarn component preferably contains 1 to 3 yarns. If one yarn is used for the ripstop yarn component, that one yarn must have at least 20% greater tensile strength than the tensile strength of a body fabric yarn component; if three yarns are used for the ripstop yarn component, then the combined three yarns must have a tensile strength of at least 20% or greater than that of the body fabric component. If more than one yarn is used as the ripstop yarn component, the yarns may be plied together or may be used without plying. The total denier of the ripstop yarn component is in the range of 200 denier to 1500 denier and the denier of yarns suitable for use in the ripstop yarn component is in the range of 200–1000 denier. The ripstop yarn component can also have, combined with, or in addition to, the fire-resistant yarn, up to 20 percent nylon fiber for improve abrasion resistance.

Preferably, textured continuous filament 600 denier PPD-T yarn is used as the ripstop yarn component of this invention. It is also preferred that the continuous multifilament yarn used in the ripstop yarn component be textured or bulked to co-mingle the filaments and create a random entangled loop structure in the yarn. One process known in the art which accomplishes this is called air-jet texturing wherein pressurized air, or some other fluid, is used to rearrange the filament bundle and create loops and bows along the length of the yarn. In a typical process, the multi-filament yarn to be bulked is fed to a texturing nozzle at a greater rate than it is removed from the nozzle. The pressurized air impacts the filament bundle, creating loops and entangling the filaments in a random manner. For the purposes of this invention, it is desirable to have an overfeed rate of 14 to 25% with a usable range in the order of 5 to 30%. Using a bulking process with this overfeed rate creates a co-mingled yarn having a higher weight per unit length, or denier, than the yarn that was fed to the texturing nozzle. It has been found that the increase in weight per unit length should be in the range of 3 to 25 wt %, with increases in the 10–18 wt % preferred. It has been found that the bulked yarn that is most useful in the making of the fabric in this invention is preferably in the range of 200 to 1000 denier, and more preferably 300 to 600 denier. The loops and entanglements create a continuous filament yarn which has some surface characteristics similar to a spun staple yarn.

The cut resistant yarn component of the fabric of this invention contains at least one yarn having a sheath/core construction wherein the sheath comprises synthetic fibers and the core comprises inorganic fibers. The fibers in the sheath are comprised of synthetic staple fibers for they create a more comfortable yarn. Preferably, the synthetic fibers in the sheath comprises cut resistant fibers, which can include any number of fibers made from poly (para-phenylene terephthalamide) (PPD-T) and other high strength polymers such as poly-phenylene benzobisoxazole (PBO) and mixtures or blends thereof. It is preferred that that the cut resistant fibers also be fire resistant and the preferred fire retardant and cut resistant fiber is PPD-T fiber. The sheath can also include some fibers of other materials to the extent that decreased cut resistance, due to that other material, can be tolerated. The cut resistant yarn component can also have, combined with or in addition to the cut resistant fibers, up to 20 percent by weight nylon fiber for improve abrasion resistance.

The core of the yarn contains at least one inorganic fiber. Inorganic fibers useful in the core include glass fiber or fibers made from metal or metal alloys. The metal fiber core can be a single metal fiber or several metal fibers, as needed or desired for a particular situation. The preferred core fiber is a metal fiber made from stainless steel. By metal fibers is meant fibers or wire made from a ductile metal such as stainless steel, copper, aluminum, bronze, and the like. The metal fibers are generally continuous wires and are 10 to 150 micrometers in diameter, and are preferably 25 to 75 micrometers in diameter.

The staple fibers comprising the sheath can be wrapped or spun around metal fiber core. If wrapped, the staple fibers are generally in the form of staple fibers loosely consolidated or spun by known means, such as, ring spinning, wrap spinning, air-jet spinning, open-end spinning, and the like; and then wound around the metal core at a density sufficient to substantially cover the core. If spun, the staple fiber sheath is formed directly over metal fiber core by any appropriate sheath/core-spinning process such as DREF spinning or so-called Murata jet spinning or w another core spinning process. The fire retardant PPD-T staple fibers present in the sheath have a diameter of 5 to 25 micrometers and may have a length of 2 to 20 centimeters, preferably 4 to 6 centimeters. Once the staple fibers are wrapped or spun around the core, these sheath/core yarns having the preferred metal fiber core are generally 1 to 50 weight percent metal with a total linear density of 100 to 5000 dtex.

Figure 2:
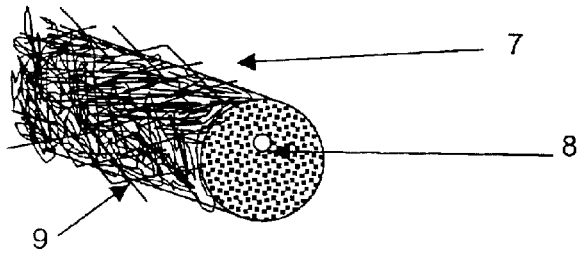
FIG. 2 is illustration of a cut resistant yarn having a staple fiber sheath/and inorganic core construction.

FIG. 2 is an illustration of a cut resistant yarn 7 which may be used in the cut resistant yarn component of this invention. The yarn has a staple fiber sheath 9 which is disposed around a inorganic core fiber 8. The cut resistant yarn component of this fabric can be made from a combination of plied yarns, although only one of the yarns in this combination of plied yarns is required to have the sheath/core construction. For example, if the cut resistant yarn component is to have three yarns, these three yarns can be twisted or plied about each other to form a plied yarn. However, only one of the three yarns is required to have the sheath/core construction. Likewise, for example, if the cut resistant yarn component is to have four yarns, these four yarns can be paired and then twisted or plied about each other to form two plied yarns. However, only one of the four yarns is required to have the sheath/core construction. Plied yarns are yarns that are brought together with only a small amount of twist, normally in the range of 5 to 10 turns or twists per inch. This low amount of twisting provides for a consolidated and balanced yarn without totally covering or wrapping one yarn with the other yarn.

The remaining yarns in the cut resistant yarn component can have almost any construction, but it is desired that they be comprised of predominantly fire resistant materials so as to maintain the fire resistant nature of the garment. Specifically, these remaining yarns can be made from aramid staple fibers or continuous aramid filaments, and may contain other fibers and materials. However, it must be recognized the fire retardancy and/or cut resistance of the fabric may be diminished by the presence of such other materials. Typically, these remaining yarns can have a linear density in the range of 200 to 2000 dtex and the individual filaments or fibers have a linear density of 0.5 to 7 dtex, preferably 1.5 to 3 dtex.

The preferred construction of the cut resistant yarn component is a plied yarn made from two sheath/core yarns wherein each yarn the sheath is staple fiber PPD-T having a cut length of 1.89 cm and the core is 1.5 mil diameter stainless steel. The preferred yarn has a cotton count sizing of 16/2 to 21/2 (664–465 denier). Optionally, the sheath/core yarns may have in addition to the fire retardant cut resistant fiber in the sheath up to 10 weight percent and as much as 20 weight percent nylon, based on the weight of the sheath fiber, to provide improved abrasion resistance.

FIG. 1 illustrates some of the possible fill yarn components separated by interweaving orthogonal warp yarn components. A body yarn component 1 made from, for example, a collection of staple yarns, is shown separated from such things as other body yarn components 1, ripstop yarn components 3, and cut resistant yarn components 2 by the interweaving warp yarn component 6. The cut resistant yarn component 2 is shown as a plied yarn made from two staple sheath/inorganic core cut resistant yarns, with the inorganic core shown in those yarns not to scale but magnified for illustration purposes. Various other types of yarn components are also shown in FIG. 1. For example, a cut resistant yarn component 4 is shown as a combination of a plied yarn made from two staple sheath/core cut resistant yarns and another plied yarn which could be made from two staple fiber yarns. Also shown is a body fabric yarn component 5 made up from a combination of a single yarn and two plied yarns, each made from two staple yarns. Similar types of yarn components can be present in the warp direction.

The woven fabric of this invention typically has a predominance of body fabric yarn components with only enough of the ripstop yarn components and cut resistant components to allow the fabric to perform in the fabric's intended use. Since most woven fabrics generally have orthogonal warp and fill yarn components, it is preferred to have ripstop yarn components and cut resistant yarn components in both the warp and fill directions. Further, it is desired to distribute the ripstop yarn components throughout the fabric in both the warp and fill directions so that the durability imparted by the ripstop yarn component is uniform across the fabric. Further, it is believed that the most useful fabrics are made when the ripstop yarn component is distributed in the fabric as every fifth to ninth orthogonal warp and fill yarn component in the fabric, with the preferred spacing having a ripstop yarn component every seventh warp and fill yarn component. If a high proportion of the body fabric yarn components are made from staple yarns, it will be desirable to bulk or texture the ripstop yarn which is distributed in the warp and fill.

Figure 3:
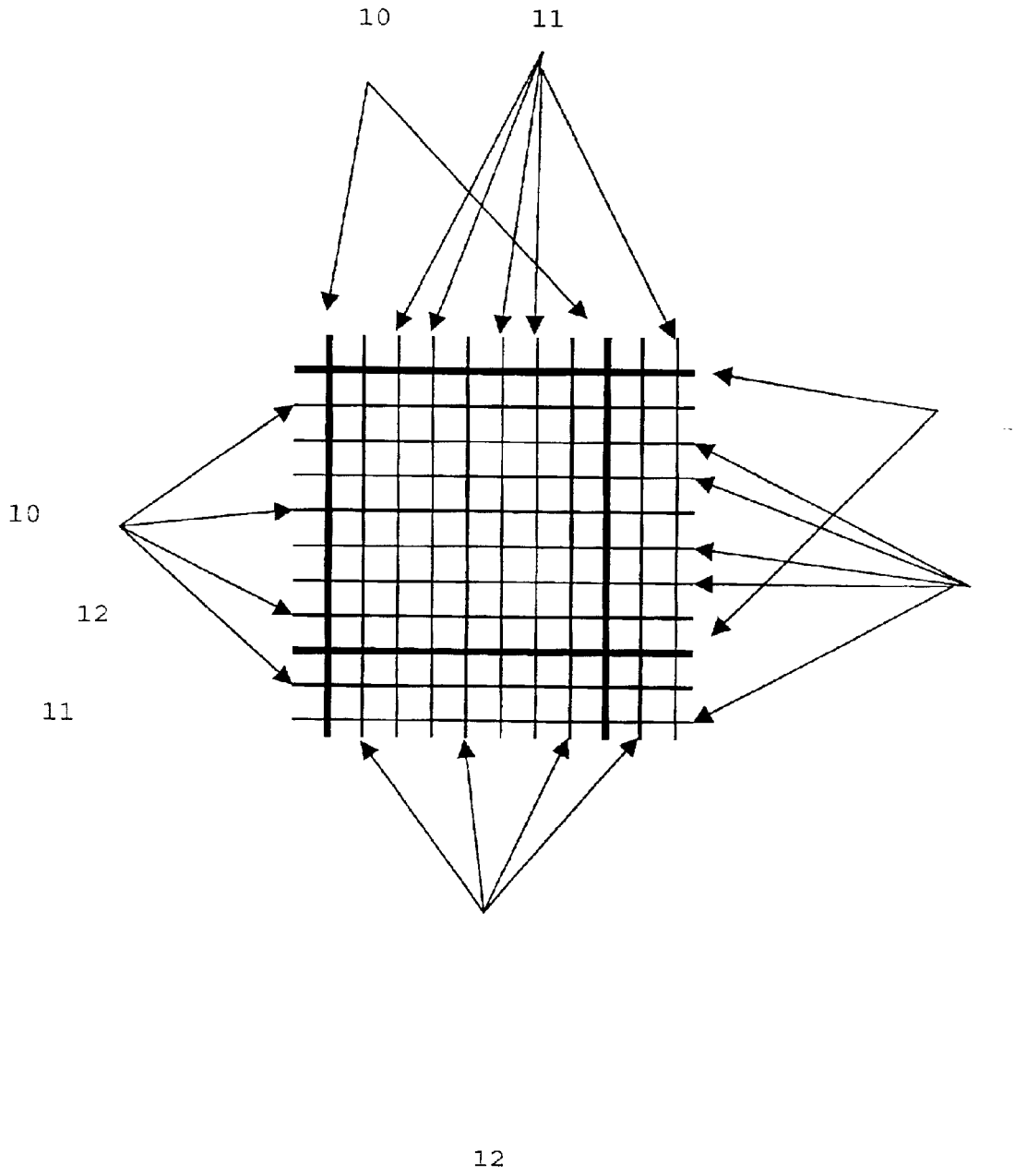
FIG. 3 is an illustration of one embodiment of the fabric of this invention.

It is also desired that the cut resistant yarn component be adequately distributed in both the orthogonal warp and fill directions of the fabric. For convenience the cut resistant yarn component can be positioned between every ripstop yarn component in both the warp and fill. FIG. 3 is an illustration of one embodiment of the fabric of this invention with the warp and fill yarn components shown broadly separated and simplified for illustration purposes. Ripstop yarn components 10 are shown in both the warp and fill and are present as every eighth component in the fabric. Body fabric yarn components 11 are shown in both the warp and fill between the ripstop yarn components and cut resistant yarn components 12 are shown in both the warp and fill between the ripstop yarn components.

Figure 4:
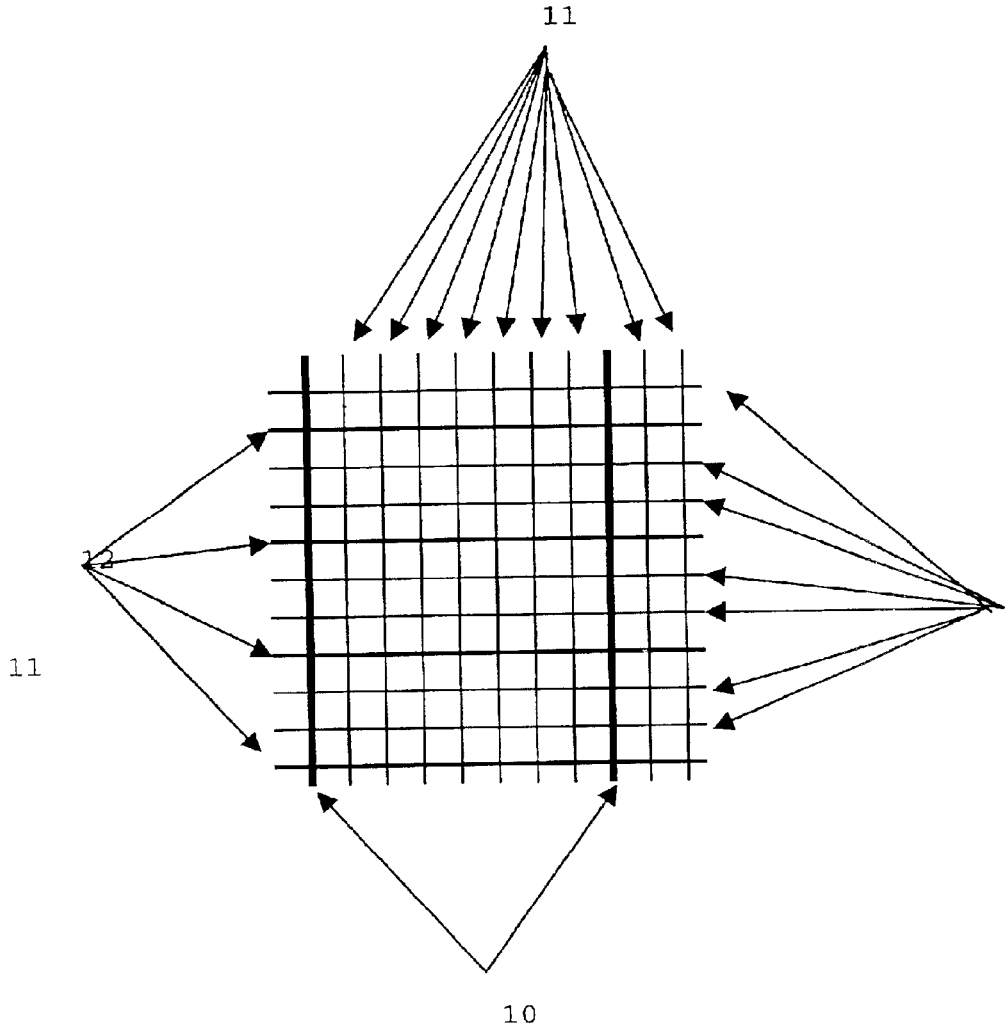
FIG. 4 is an illustration of another embodiment of the fabric of this invention.

In another embodiment of this invention, the woven fabric of this invention comprises body fabric yarn components, synthetic ripstop yarn components, and cut resistant yarn components, wherein the ripstop yarn component has at least 20% greater tensile strength than the body fabric yarn component, the cut resistant yarn component comprises a yarn having a synthetic staple-fiber sheath and an inorganic core, and the ripstop yarn components are orthogonal to the cut-resistant yarn components. The ripstop yarn component can contain a textured or bulked continuous filament yarn. FIG. 4 is an illustration of this type of fabric. The ripstop yarn components 10 are shown only in the warp direction and all other warp yarns are body fabric yarn components 11. The cut resistant yarn components 12 are shown in the fill direction along with more body fabric yarn components 11.

The process for making the fabric of this invention comprises weaving a fabric from a body fabric yarn component and a cut resistant yarn component comprising a yarn having a synthetic staple fiber sheath and an inorganic core and inserting into the weave at every fifth to ninth warp and fill component a synthetic ripstop yarn component having at least 20% greater strength than the body fabric yarn component.

Another embodiment of the process for making the woven fabric of this invention having orthogonal yarn components involves weaving a fabric from a body fabric yarn component, inserting into the weave at every fifth to ninth yarn component a synthetic ripstop yarn component, creating a parallel array of synthetic ripstop yarn components in the fabric, each component having at least 20% greater tensile strength than the body fabric yarn component, and inserting into the weave, orthogonal to the array of parallel ripstop yarn components, a parallel array of cut-resistant yarn components, each cut resistant yarn component comprising a yarn having a synthetic staple fiber sheath and an inorganic core.

The fabrics of this invention are useful in and can be incorporated into protective garments, especially garments known as turnout gear which are useful for firefighters, and garments also have use in industrial applications where workers may be exposed to abrasive and mechanically harsh environments where fire and flame protection is needed. The garments, may include coats, coveralls, jackets, pants, sleeves, aprons, and other types of apparel where protection against fire, flame, and heat is needed.

Test Methods

Thermal Protective Performance Test (TPP)

The predicted protective performance of a fabric in heat and flame was measured using the "Thermal Protective Performance Test" NFPA 2112. A flame was directed at a section of fabric mounted in a horizontal position at a specified heat flux (typically 84 $kW/m^2$). The test measures the transmitted heat energy from the source through the specimen using a copper slug calorimeter with no space between the fabric and heat source. The test endpoint is characterized by the time required to attain a predicted second-degree skin burn injury using a simplified model developed by Stoll & Chianta, "Transactions New York Academy Science", 1971, 33 p 649. The value assigned to a specimen in this test, denoted as the TPP value, is the total heat energy required to attain the endpoint, or the direct heat source exposure time to the predicted burn injury multiplied by the incident heat flux. Higher TPP values denote better insulation performance. A three layer testing sample is prepared consisting of outer shell fabric (current invention), a moisture barrier and a thermal liner. The moisture barrier was Crosstech® membrane attached to a 2.7 $oz/yd^2$ (92 grams/square meter) Nomex®/Keviar® fiber substrate and the thermal liner consisted of three spunlaced 1.5 $oz/yd^2$ (51 grams/square meter) sheets quilted to a 3.2 $oz/yd^2$ (108 grams/square meter) Nomex® staple fiber scrim.

Abrasion Resistance Test

Abrasion resistance was determined using ASTM method D3884–80, with a H-18 wheel, 500 gms load on a Taber abrasion resistance available from Teledyne Taber, 455 Bryant St., North Tonawanda, N.Y. 14120. Taber abrasion resistance is reported as cycles to failure.

Cut Resistance Test

Cut resistance was measured using the "Standard Test Method for Measuring Cut Resistance of Materials Used in Protective Clothing", ASTM Standard F 1790–97. In performance of the test, a cutting edge, under specified force, was drawn one time across a sample mounted on a mandrel. At several different forces, the distance drawn from initial contact to cut through was recorded and a graph constructed of force as a function of distance to cut through. From the graph, the force was determined for cut through at a distance of 25 millimeters and was normalized to validate the consistency of the blade supply. The normalized force was reported as the cut resistance force. The cutting edge was a stainless steel knife blade having a sharp edge 70 millimeters long. The blade supply was calibrated by using a load of 400 g on a neoprene calibration material at the beginning and end of the test. A new cutting edge was used for each cut test. The sample was a rectangular piece of fabric cut 50×100 millimeters on the bias at 45 degrees from the warp and fill directions. The mandrel was a rounded electrical conductive bar with a radius of 38 millimeters and the sample was mounted thereto using double-face tape. The cutting edge was drawn across the fabric on the mandrel at a right angle with the longitudinal axis of the mandrel. Cut through was recorded when the cutting edge makes electrical contact with the mandrel.

Tear Strength Test

The tear strength measurement is based on ASTM D 5587–96. This test method covers the measurement of the tear strength of textile fabrics by the trapezoid procedure using a recording constant-rate-of-extension-type (CRE) tensile testing machine. Tear strength, as measured in this test method, requires that the tear be initiated before testing. The specimen was slit at the center of the smallest base of the trapezoid to start the tear. The nonparallel sides of the marked trapezoid were clamped in parallel jaws of a tensile testing machine. The separation of the jaws was increased continuously to apply a force to propagate the tear across the specimen. At the same time, the force developed was recorded. The force to continue the tear was calculated from autographic chart recorders or microprocessor data collection systems. Two calculations for trapezoid tearing strength were provided: the single-peak force and the average of five highest peak forces. For the examples of this patent, the single-peak force is used.

Grab Strength Test

The grab strength measurement, which is a determination of breaking strength and elongation of fabric or other sheet materials, is based on ASTM D5034. A 100-mm (4.0 in.) wide specimen is mounted centrally in clamps of a tensile testing machine and a force applied until the specimen breaks. Values for the breaking force and the elongation of the test w specimen are obtained from machine scales or a computer interfaced with testing machine.

EXAMPLES

Example 1

A highly cut resistant and durable fabric of the present invention was prepared as follows. A body fabric yarn component was made from plied 16/2s staple yarns. Each staple yarn was composed of 50 weight percent PPD-T (Kevlar®) fiber as 1.5 dpf, 48 mm (1.89 inch) staple fiber from E. I. du Pont de Nemours & Co., Inc.; 40 weight percent PBI fiber as 1.5 dpf, 51 mm (2 inch) staple fiber; and 10 weight percent nylon staple fiber available as T200, 1.1 dpf and 38 mm (1.5 inch) staple fiber from E. I. du Pont de Nemours & Co., Inc. The yarns were made by blending and spinning the staple fibers into yarns via conventional cotton system processing.

A cut resistant yarn component was made from sheath core yarns where in each yarn the sheath was PPD-T/PBI/nylon staple fiber blends at 50%/40%/10% by weight blending ratio of the same fibers as listed above, and the core was a single 1.5 mil stainless steel wire. The PPD-T, PBI, and nylon fibers were fed through a standard carding machine used in the processing of short staple ring spun yarns to make carded sliver. The carded sliver was processed using two pass drawing (breaker/finisher drawing) into drawn sliver and processed on a roving frame to make a one hank roving. The roving was then fed into spinning frame with steel wire to form a sheath/core yarn structure. Sheath-core strands were produced by ring-spinning two ends of the roving and inserting the steel core just prior to twisting. The roving was about 5900 dtex (1 hank count). In this example, the steel cores were centered between the two drawn roving ends just prior to the final draft rollers. 16/1 cc strands were produced using a 3.5 twist multiplier for each item. The single strand of 16/1 cc was then plied to 16/2 cc to form a stable yarn and the cut resistant yarn component for further weaving. The ripstop yarn component was comprised of a 800 denier MPD-I (Nomex® fiber, available from from E. I. du Pont de Nemours & Co., Inc.) textured multifilament yarn. A 2×1 twill fabric was made-using these yarn components. The warp yarn components were made from cut resistant yarn components containing the steel-cored PPD-T/PBI/nylon yarns. The fill yarn component was PPD-T/PBI/nylon yarn, however, every 8th yarn component in the fill was replaced with a ripstop yarn component, which was 2 yarns of 800 denier MPD-I textured filament yarn. When tested this fabric showed 4 times the cut resistance and 2 times the abrasion resistance of a fabric having no cut resistant or ripstop yarn components. The tear strength in fill direction was doubled due to the MPD-I textured filaments.

Example 2

Same as example 2 in fabric construction, except replacing the 2 MPD-I textured filament yarns in the ripstop component with 2 600 denier PPD-T filament yarns. This made an even higher tear resistance fabric. The test data showed that the tear strength was 3 times higher than that of a product without the ripstop component.

Example 3

A fabric having a 7×2 ripstop plain weave construction was made illustrating the fabric of this invention. A plied steel reinforced PPD-T/nylon yarn having an overall cotton count of 16/2s and a sheath of 90 weight percent PPD-T and 10 weight percent nylon and a 1.5 mil stainless steel wire core was made for use in the cut resistant yarn component (CRYC). Two of these yarns became the cut resistant yarn component for this fabric. The ripstop yarn component (RYC) was combined yarn made from two yarns of textured 600 denier PPD-T continuous filament. A body fabric yarn having an overall cotton count of 16/2, was made bye plying two PPD-T/PBI blended staple yarns, the PPD-T being 60 weight percent of the blend and the remainder being PBI. Two of these plied body fabric yarns became the body fabric yarn component (BFYC).

The 7×2 ripstop fabric was constructed by weaving in the warp and fill yarn components in the following order, 7 refers to the number of yarn components between each ripstop yarn component and 2 refers to the number of yarns in the ripstop yarn component: RYC/CRYC/BFYC/BFYC/CRYC/BFYC/BFYC/CRYC/RYC The resulted fabric had good cut and abrasion resistance and high tear strength. Heat treatment at 265° C. for 5 minutes further improved the abrasion resistance due to nylon shrinking and locking the high modulus PPD-T fiber. All 3 examples also have higher TPP with same basis weight due to the bulkier fabric structure.

TABLE 1

| Test Type | Standard Kevlar ®/PBI Kevlar ®/PBI Blend with double end in ripstop | Example 1 Kevlar ®/PBI/nylon 2/1 twill with Nomex ® ripstop in fill | Example 2 Kevlar ®/PBI/ nylon 2/1 twill with Kevlar ® ripstop in fill | Example 3 Kevlar ®/PBI Blend with Kevlar ® textured yarn in ripstop and Kevlar ®/nylon steel yarn in every 2 ends of warp and fill |
|---|---|---|---|---|
| Basis Wt. (g/m2) | 257.6 | 267.8 | 257.6 | 257.6 |
| Thickness (mm) | 0.66 | 0.97 | 1.04 | 1.19 |
| Trap Tear (warp × fill kg) | 13.1 × 12.3 | 16.3 × 29.5 | 16.8 × 48.1 | 34.1 × 37.7 |
| Grab Strength (warp × fill kg) | 119.4 × 105.3 | 117.6 × 92.2 | 107.6 × 111.2 | 102.2 × 132.1 |
| Abrasion (cycles) | 184 | 315 | 311 | 128 |
| Cut Resistance (g) | 469 | 1607 | 1665 | 1055 |
| TPP (cal/cm^2) | 42 | 48 | 49 | 42.4 |

What is claimed is:

1. A woven fabric useful in protective apparel made from yarn components comprising:

a) a body fabric yarn component, b) a synthetic ripstop yarn component having at least 20% greater tensile strength than the body fabric yarn component, and c) a cut resistant yarn component comprising a yarn having a synthetic staple-fiber sheath and inorganic core, the body fabric yarn component, the ripstop yarn component, and cut-resistant yarn components all being comprised of at least one yarn and each yarn component distinguished from the adjacent yarn component by interweaving orthogonal yarn components.

2. The woven fabric of claim 1 wherein the ripstop yarn component comprises a textured or bulked continuous filament yarn.

3. The woven fabric of claim 1 wherein the ripstop yarn component is made from a yarn comprising poly (p-phenylene terephthalamide) fiber.

4. The woven fabric of claim 1 wherein the ripstop yarn component comprises a yarn made from fire-resistant fibers.

5. The woven fabric of claim 4 wherein the ripstop yarn component comprises, in addition to a yarn made from fire-resistant fibers, nylon fibers in an amount of up to 20% by weight of the ripstop yarn component.

6. The woven fabric of claim 1 wherein the staple-fiber sheath of the cut resistant yarn component yarn comprises staple fibers are made from poly (p-phenylene terephthalamide) and the inorganic core comprises metal fiber.

7. The woven fabric of claim 1 wherein the staple-fiber sheath of the cut resistant yarn component yarn comprises cut resistant staple fibers.

8. The woven fabric of claim 7 wherein the cut resistant yarn component yarn comprises, in addition to the cut resistant staple fibers, nylon fibers in an amount of up to 20% by weight of the cut resistant yarn component yarn.

9. The fabric of claim 1 wherein the body fabric component comprises yarns of fire-resistant fibers.

10. The woven fabric of claim 9 wherein the body fabric yarn component yarn comprises, in addition to fire-resistant fibers, nylon fibers in an amount of up to 20% by weight of the body fabric yarn.

11. A woven fabric useful in protective apparel made from orthogonal warp and fill yarn components comprising:

a) a body fabric yarn component, b) a synthetic ripstop yarn component having at least 20% greater tensile strength than the body fabric yarn component, and c) a cut resistant yarn component comprising a yarn having a synthetic fiber sheath and inorganic core, the body fabric yarn component, the ripstop yarn component, and cut-resistant yarn components all being comprised of individual or plied warp and fill yarns in the fabric, and wherein every fifth to ninth orthogonal warp and fill yarn component is a ripstop yarn component.

12. The woven fabric of claim 11 wherein the cut resistant yarn component is positioned between every ripstop yarn component in both the warp and fill.

13. The woven fabric of claim 11 wherein the ripstop yarn component comprises a textured or bulked continuous filament yarn.

14. A woven fabric useful in protective apparel made from orthogonal yarn components comprising:

a) a body fabric yarn component, b) a synthetic ripstop yarn component having at least 20% greater tensile strength than the body fabric yarn component, and c) a cut resistant yarn component comprising a yarn having a synthetic staple-fiber sheath and inorganic core, the body fabric yarn component, the ripstop yarn component, and cut-resistant yarn components all being comprised of at least one yarn and each yarn component distinguished from the adjacent yarn component by interweaving orthogonal yarn components, said ripstop yarn components being orthogonal to said cut resistant yarn components.

15. The woven fabric of claim 14 wherein the ripstop yarn component comprises a textured or bulked continuous filament yarn.

16. A process for making a woven fabric useful in protective apparel made from warp and fill yarn components comprising:

a) weaving a fabric from a body fabric yarn component and a cut-resistant yarn component, the cut resistant yarn component comprising a yarn having a synthetic staple-fiber sheath and inorganic core, and b) inserting into the weave at every fifth to ninth warp and fill component a synthetic ripstop yarn component having at least 20% greater tensile strength than the body fabric yarn component.

17. A process for making a woven fabric useful in protective apparel made from orthogonal yarn components comprising:

a) weaving a fabric from a body fabric yarn component, b) inserting into the weave at every fifth to ninth yarn component a synthetic ripstop yarn component to create a parallel array of ripstop yarn components, each component having at least 20% greater tensile strength than the body fabric yarn component, and c) inserting into the weave, orthogonal to the array of parallel ripstop yarn components, a parallel array of cut-resistant yarn components, each cut resistant yarn components comprising a yarn having a synthetic staple-fiber sheath and inorganic core.

* * * * *